US007290506B2

(12) United States Patent
Rau, III et al.

(10) Patent No.: US 7,290,506 B2
(45) Date of Patent: Nov. 6, 2007

(54) FLUID-COOLED CYLINDER LINER

(75) Inventors: Charles Benjamin Rau, III, Gig Harbor, WA (US); Dallas W. Jolley, Jr., University Place, WA (US)

(73) Assignee: Benmaxx, LLC, Tacoma, WA (US)

( * ) Notice: Subject to any disclaimer, the term of this patent is extended or adjusted under 35 U.S.C. 154(b) by 0 days.

(21) Appl. No.: 11/050,994

(22) Filed: Feb. 4, 2005

(65) Prior Publication Data

US 2005/0274333 A1 Dec. 15, 2005

Related U.S. Application Data

(60) Provisional application No. 60/542,955, filed on Feb. 9, 2004, provisional application No. 60/646,239, filed on Jan. 21, 2005.

(51) Int. Cl.
*F02F 1/10* (2006.01)

(52) U.S. Cl. ..... 123/41.84

(58) Field of Classification Search ..... 123/41.84, 123/193.2, 41.74, 41.79
See application file for complete search history.

(56) References Cited

U.S. PATENT DOCUMENTS

| | | | | |
|---|---|---|---|---|
| 4,050,421 | A | 9/1977 | Cendak | |
| 4,172,435 | A * | 10/1979 | Schumacher | 123/41.72 |
| 4,662,321 | A * | 5/1987 | Devaux | 123/41.79 |
| 4,950,962 | A | 8/1990 | Birnbach et al. | |
| 5,062,393 | A * | 11/1991 | Smith et al. | 123/41.72 |
| 5,176,113 | A * | 1/1993 | Hama et al. | 123/41.79 |
| 5,199,390 | A * | 4/1993 | Hama et al. | 123/41.84 |
| 5,207,189 | A * | 5/1993 | Kawauchi et al. | 123/41.84 |
| 5,209,197 | A * | 5/1993 | Melchior | 123/193.3 |
| 5,477,820 | A * | 12/1995 | Rao | 123/193.6 |
| 6,167,847 | B1 * | 1/2001 | Ergezen et al. | 123/41.79 |
| 6,729,269 | B2 * | 5/2004 | Ott et al. | 123/41.31 |
| 2003/0000486 | A1 * | 1/2003 | Ott et al. | 123/41.31 |

* cited by examiner

*Primary Examiner*—Stephen K. Cronin
*Assistant Examiner*—Jason Benton
(74) *Attorney, Agent, or Firm*—Barry L. Davison; Davis Wright Tremaine LLP

(57) ABSTRACT

Particular embodiments of the present invention provide novel fluid-cooled cylinder liners. Preferred liners are annular cylinders containing a plurality of passages, arranged generally parallel to the axis of the cylinders, and integrated between the inner and outer surfaces of the cylinders. Preferably, the integral passages are arranged so that they are typically closer to the outer surface of the liner than the inner surface. Each passage has at least two openings. A passage with two openings on opposite end of the cylinder runs the entire length of the liner, while a passage with a opening at one end of the liner and a second opening along a surface of the liner runs only for a fraction of the liner length. In preferred embodiments, openings on the outer surface of the liner will be arranged in a circle lying on a plane perpendicular to the axis of the cylinder, and near either end of the cylinder; ensuring that each passage traverses the majority of the length of the liner. Preferably, the cylinder liners comprise at least one material selected from the group consisting of aluminum, a aluminum-based metal matrix composite (MMC) with a particulate reinforcement, superalloys, ceramic matrix composite (CMC), and carbon graphite foam. Preferably, the liners comprise a heating element.

21 Claims, 3 Drawing Sheets

FLUID-COOLED CYLINDER LINER

CROSS-REFERENCE TO RELATED APPLICATIONS

This application claims the benefit of priority to U.S. Provisional Patent Application Ser. No. 60/542,955 filed 9 Feb. 2004 and entitled FLUID-COOLED CYLINDER LINER, and to U.S. Provisional Patent Application Ser. No. 60/646,239, filed 21 Jan. 2005 of same title, both of which are incorporated by reference herein in their entirety.

FIELD OF THE INVENTION

The invention generally relates to cooling or preheating internal combustion engines, and more particularly to cooling or preheating cylinder liners by passing fluids through internal passages in the cylinder liners.

BACKGROUND

A direct result of the increased horsepower of modern automotives engines is the proportional increase in the heat generated by these engines. The heat generated by internal combustion engines tends to degrade many of the components of the engine. The high heat at which these engines run also tends to increase emissions, especially of nitrogen oxide. The Environmental Protection agency and the Corporate Average Fuel Efficiency ("CAFE") standards adopted by the Department of Transportation has identified the reduction of nitrogen oxide as one of their goals. In order to address the CAFE standards and the negative impact of the increased heat generation in today's high horsepower engines, automotive manufacturers have had to resort to increasingly complex cooling systems for these engines. The complexity of these cooling systems has increased not only the expense of manufacturing these engines, but also their weight and the potential for flaws in the cooling system—both during manufacture and while in use.

Three components or regions of the internal combustion engine where heat is concentrated are the combustion chambers, cylinder bores, and pistons. To cool these regions or components, internal combustion engines are designed with numerous passages through which fluids—oil, water, coolants, or gases (e.g., air)—are circulated to draw heat away from the engine block. Furthermore, engine designs incorporate cylinder liners to avoid degradation of the cylinder bores caused by heating and cooling. A cylinder liner, typically made of ductile iron, is a hollow cylinder whose outside diameter is close to the internal diameter of the cylinder bore, so that the liner fits inside the cylinder bore snugly. The piston travels inside the cylinder liner, thus heating up the cylinder liner first instead of directly transferring its heat to the cylinder bore and the engine block itself. The use of cylinder liners helps alleviate degradation of the cylinder bore due to the heat, but in turn creates problems related to degradation of the cylinder liners due to excessive heating. Thus, cylinder liners are a fourth component of internal combustion engines that are subject to degradation and failure due to excessive heating. Because cylinder liners are such an integral part of the design of internal combustion engines and because they play such a crucial role in avoiding degradation of the engine block itself, various techniques have been developed expressly to address the cooling of cylinder liners in today's high horsepower engines.

Cylinder liners can be either of the dry-sleeve or wet-sleeve design. In a wet-sleeve design, a cooling medium is present between at least part of the interior surface of the cylinder bore and the outer surface of the liner. The engine block is designed with a complex series of passages for this cooling medium to be brought in contact with the liner and then removed to a heat exchange location (e.g., a radiator) where the medium can release the heat it drew from the cylinder liner and cylinder bore. In a dry-sleeve design, the outer surface of the liner and the interior surface of the cylinder bore are for the most part in direct contact. Although there is no fluid present between the interior surface of the cylinder bore and the outer surface of the cylinder liner, fluids are still circulated within the engine block, through a complex series of passages, to draw heat away from the cylinder bore and the cylinder liner. The complexity of the layout of the passages and process of circulating the cooling medium uniformly round all of the cylinder bores is especially accentuated in engines where the cylinder bores are arranged in a "V"-formation (e.g., V-8s and V-12s) because these engines tend to have reservoirs for the cooling medium arranged on one-side of the engine; necessitating a complex series of passages to circulate fluids to the other side.

In some engines, oil is squirted through a small tube or plurality of tubes into the bottom of the cylinder bore and allowed to hit the bottom of the piston. The oil that is squirted in, using these "oil squirters" or "piston squirters," cools down the piston and increases lubrication. Piston squirters are not incorporated as part of the system of passages that carry the cooling medium but instead are incorporated as separate systems dedicated only to transporting oil from the oil-pan to the bottom of the cylinder bore.

In addition to the increased cost of engine block design and manufacture necessitated by the current dry-sleeve or wet-sleeve design, a primary shortcoming of the wet-sleeve design is the non-uniform distribution of the cooling fluid surrounding the cylinder liner. The non-uniform distribution leads to uneven cooling of the liner, the development of hot spots, and the eventual cracking or failure of the liner. Prior art wet-sleeve designs have attempted to address this problem by changing the shape and structure of the outer surface of the cylinder liner (e.g., U.S. Pat. No. 6,675,750 to Wagner). However, while this design increases the surface area of the liner that is exposed to the cooling medium, it fails to address the problem of non-uniform distribution of the cooling fluid because the fluid is not in contact with the entire axial length of the liner.

This design also does not reduce the requirement for a complex series of passages within the engine block for circulating the cooling medium to and from the area between the cylinder bore and the cylinder liner. Furthermore, the design increases the complexity and manufacturing cost of producing cylinder liners by changing the typically planar outer surface of the liner to "an outer surface with a plurality of peaks and valleys" (see U.S. Pat. No. 6,675,750 patent, at col. 2, 11, 15-16).

Additionally, while the above-described designs and approaches are directed at cooling the cylinder areas, they do not address the problem presented by engine 'cold-start' and idle periods; during which times substantial excessive pollution/emissions are generated because the cylinders are not at an appropriate temperature to provide for optimally efficient combustion. This is a serious problem in the trucking industry, and has led to increasingly more stringent regulations regarding idling periods. Therefore, the above-described prior art efforts to improve cooling of cylinder liners actually create additional problems from the standpoint of pollutants being generated during cold-starting and idling.

There is, therefore, a pronounced need in the art for cylinder liners that are cost effective and easy to manufacture, allow uniform distribution of cooling fluids along their axial length, and facilitate the design of simpler engine blocks with less complicated passages for circulating cooling fluids. There is also a pronounced need in the art for piston squirters integrated into the circulation system for cooling the cylinder liner and cylinder bore, to preclude the need for an entirely separate squirter circulation system. Moreover, there is a pronounced need for cylinder liners that allow for different cooling fluids (e.g., oil and water, or oil and ethylene-glycol, or water and a compressed inert gas such as nitrogen) to be independently circulated through the liner. Where oil is used as the liner cooling medium, there is also a need for cylinder liners that allow for the oil to circulate within a closed loop, thus avoiding directing oil on to the crankshaft. Oil directed (e.g., dripped) on the crankshaft leads to increased emissions and peristaltic drag, thus a design that eliminates direction of oil onto the crankshaft decreases emissions as well as peristaltic drag. Furthermore, there is a pronounced need in the art for cylinder liners with enhanced thermal conductivity to improve heat transfer/dissipation. Finally, there is a pronounced need in the art for cylinder liners that have enhanced electrical conductivity to allow for thermoelectric heating of the cylinder liners during engine warm-up, particularly in larger engines such as, but not limited to diesel engines of, for example, trucks and the like. There is a need to shorten warm-up periods and reduce pollution, while still providing for cooling and enhanced engine life.

SUMMARY OF THE INVENTION

Particular embodiments of the present invention provide for novel fluid-cooled cylinder liners, comprising a generally annular cylindrical member having top and bottom cylinder ends, and having parallel or generally parallel inner and outer surfaces. The cylinder member comprises a fluid channel integrated within and between the surfaces of the member, wherein the channel has a first and a second ends. Additionally, there are first and second channel openings at or near the first and second channel ends, respectively, wherein one channel opening opens to at least one of a cylinder end and the outer cylinder surface, wherein the other channel opening opens to at least one of a cylinder end, the other cylinder end, the outer cylinder surface, and the inner cylinder surface, and wherein the channel and channel openings define a fluid passageway. Preferably, the cylinder liner comprises a plurality of separate fluid channels. Preferably, the cylinder liners further comprise a flange at the top cylinder end, the flange suitable to be received into a counterbore in a cylinder bore. Preferably the cylinder liner comprises at least one of aluminum and aluminum alloy, or consists of or comprises at least one material selected from the group consisting of: aluminum-based metal matrix composite (MMC), comprising a particulate reinforcement (e.g., DURALCAN®, containing silicon carbide, and manufactured by Alcan Aluminum Limited); superalloys; ceramic matrix composite (CMC); 'carbon graphite foam'; or manganese-bronze having a particulate reinforcement such as, but not limited to silicon carbide (e.g., from about 10% to about 35%). Preferably, the cylinder liner comprises MMC, CMC or carbon graphite foam, with at least one of silicon carbide, and silicon nitrate. The cylinder liners can manufactured by standard casting methods. Preferably, infusion casting is used; for example, aluminum-based alloys (e.g., eutecic, hypereutectic, or otherwise), with or without particulate reinforcement are cast into (e.g., infiltration casting) a porous 'preform' (e.g., MMC, CMC, ceramic, or carbon graphite foam 'preform').

In particular embodiments, the cylinder member comprises a single continuous, integrated, serpentine channel with the channel ends subtended by two openings, wherein the channel traverses substantially throughout the interior surface of the cylinder liner and the channel openings open to at least one of: the same cylinder end; opposite cylinder ends; the outer cylinder surface (both); and to one end (one opening) and the outer surface (the other opening).

In preferred embodiments, the channels comprise a third opening positioned along the channel somewhere between the first and second openings, wherein the third opening opens to the outer cylinder surface. Preferably, such embodiments further comprise a fluid-directing tube connected to a channel opening in the bottom cylinder end.

Preferably, the cylinder liners comprise a plurality of channels all having one channel opening at the same cylinder end, and all having one channel opening at the outer cylinder surface near the other cylinder end, and positioned in a circular arrangement running parallel to the cylinder ends. Preferably, such embodiments further comprise two circular groves on the outer surface of the cylinder liner parallel to the arrangement of openings on the outer surface suitable to receive sealing means (e.g., O-rings).

In yet further embodiments, the cylinder liners further comprising a plurality of channels and a circular trough perpendicular to the cylinder axis and recessed into the outer cylinder surface, wherein a plurality of channel openings open into the trough to form a circular arrangement of channel openings within the trough.

In particularly preferred embodiments, the cylinder liner comprises 'carbon graphite foam'. Preferably, infusion casting is used. For example, an aluminum-based alloys (e.g., eutecic, hypereutectic, or otherwise), with or without particulate reinforcement are cast into (e.g., infiltration casting) a 'preform' of porous 'carbon graphite foam' (with or without particulate reinforcement, such as silicon carbide). Carbon graphite foam (developed at Oak Ridge National Laboratory, USA) has high thermal conductivity and also acts as super-conductor (see, e.g., U.S. Pat. Nos. 6,673,328, 6,663,842, 6,656,443, 6,398,994, 6,387,343 and 6,261,485, all of which are incorporated by reference herein in their entirety). Preferably the silicon carbide volume should be from about 10% to 35% to provide desired friction at wear plate rubbing surface. Infiltration of un-reinforced or reinforced alloy into carbon graphite foam 'preform' is during a suitable casting procedure including, but not limited to die casting, high-vacuum permanent mold casting, squeeze casting, or centrifugal casting. According to the present invention, carbon graphite foam can be included in the compositions of at least one of the cylinder liner, and any parts in contact therewith. According to the present invention, the use of carbon graphite foam 'preforms' not only substantially reduces manufacturing costs (e.g., relative to the use of ceramic 'preforms'), but provides an environmentally responsible cylinder liner, because carbon graphite foam is manufactured from a by-product of coal fabrication.

In preferred embodiments the cylinder liner comprises carbon graphite foam, and additionally comprises, or is in communication with at least one heating element (e.g., electrical resistive element), which is optionally in communication with external controller means, to allow for heating, or regulated heating of the cylinder liner (e.g., prior to or during engine cold-start periods, and/or idling periods).

DETAILED DESCRIPTION OF THE INVENTION

Figure 1:
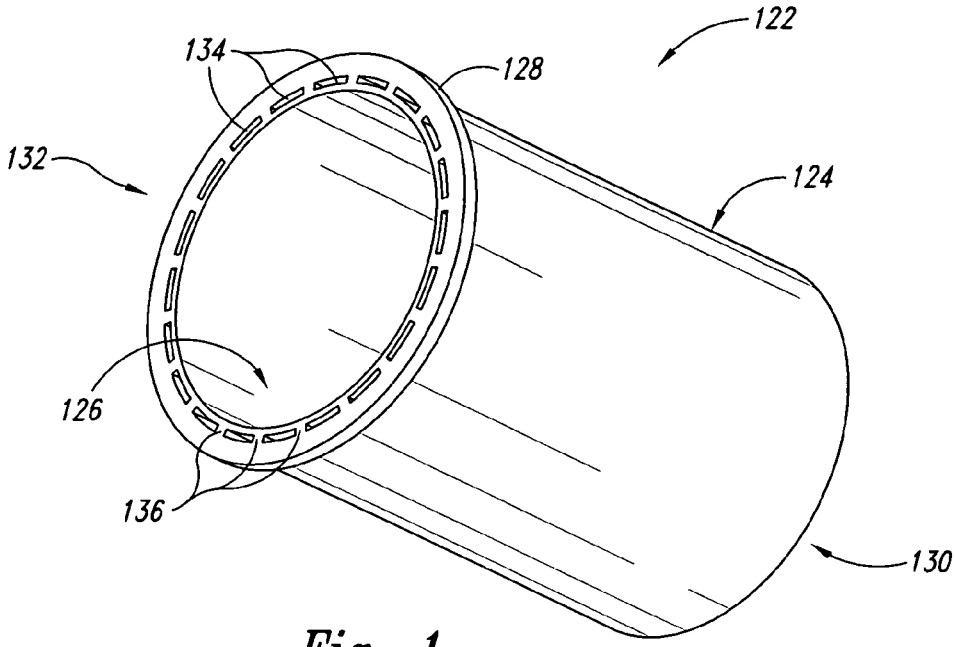
FIG. 1 is a perspective view of one embodiment of an inventive cylinder liner 122 with openings 134 along the end of the cylinder liner proximate to the cylinder head visible. The openings lead to longitudinal passages within the liner.

Particular embodiments of the present invention provide novel fluid-cooled cylinder liners. Preferred liners are generally in the shape of annular cylinders and contain a plurality of passages; arranged parallel to the axis of the cylinder, between the inner and outer surfaces of the cylinders. Preferred passages are arranged so that they are typically closer to the outer surface of the cylinder than the inner surface. Each passage has at least two openings. Openings that appear at either end of the cylinder are referred to herein as "ports," whereas those that appear along the inner or outer surface of the cylinder are referred to herein as "windows." Thus, a passage with two ports (with one on either end of the cylinder) would run the entire length of the cylinder, while a passage with a port and a window or a passage with two windows would run only for a fraction of the cylinder length. Although windows can be arranged at any position along the outer or inner surfaces of the cylinder liner, in the preferred embodiments windows will be arranged along the outer surface of the cylinder liner, in a circle lying on a plane perpendicular to the axis of the liner, and close to either end of the liner; ensuring that each passage with windows traverses the majority of the length of the cylinder. Other embodiments of the invention contain a plurality of passages parallel to each other but traveling in a spiral path within the cylinder surfaces. Embodiments could also include a plurality of "short" passages aligned along a line parallel to the axis of the cylinder with each passage covering only a short fraction of the length, but the plurality of passages lying along one such line serving the role of one of the longer passages in the preferred embodiments. Further embodiments incorporate windows within the inner surface of the cylinder liner, allowing for the cooling medium (possibly oil) to drain into the cylinder bore below the piston rings.

Ports along the "top" of in the cylinder liner, that is, along the end of the cylinder liner closest to the combustion chamber, would be aligned with conforming openings in the cylinder head. Ports along the "bottom" of the cylinder liner would either open into the cylinder bore or be aligned with openings along a "step" in the cylinder bore on which the cylinder liner would sit. As is true in the prior art, the cylinder head and the top of the cylinder liner would be preferably separated by a gasket and in embodiments incorporating a step, the cylinder liner bottom and the step would preferably be separated by a gasket. Such gaskets have gasket windows appropriately aligned to create passages from the cylinder head into the cylinder liner or the cylinder liner into the engine block respectively.

In preferred embodiments, cylinder liners with windows along the outer surface are aligned with openings into passages within the engine block. Preferably, each circular arrangement of windows along the outer liner surface is located between two circular groves on the outer surface of the cylinder liner, the groves being parallel to the circular arrangement of windows. Preferably, O-rings are inserted into these groves, with part of the O-ring extending beyond the outer surface of the cylinder liner, so that when the liner is inserted into a cylinder bore a sealed, annular region is formed; bound by the O-rings, the outer surface of the cylinder liner, and the interior surface of the cylinder bore.

A different embodiment of the invention includes a shallow, circular trough along the outer surface of the cylinder liner, lying on a plane perpendicular to the axis of the cylinder. Windows are arranged in a circle along the center of the trough, and a band containing a plurality of openings each opening surrounded on each side of the band by O-rings would fit therein. Preferably, the band is the same width as the width of the trough, and has the same thickness as the depth of the trough, so when the band is placed within the trough its outer surface coincides with the outer surface of the cylinder liner. The plurality of band openings are equal in number to the windows within the trough, and are arranged so that an opening (which could be slightly larger than a window) fits over each of the windows. In this embodiment, the windows are aligned with openings for passages within the engine block with the gaskets on the band creating a seal for each window-passage opening alignment, thus creating separate, sealed passages between the cylinder liner and the engine block. In particular embodiments, different fluids are transported by different passages without the fluids intermingling.

Passages allow cooling media to circulate through the cylinder liner. Depending on the direction of flow, the cooling media could: enter or exit into the cylinder head (in embodiments in which ports on top of the cylinder liner are aligned with openings for passages within the cylinder head); enter or exit into the engine block (in embodiments in which windows are aligned with openings for passages in the engine block or in which the cylinder liner has ports along the bottom aligned with openings in a step on which the cylinder liner sits); or drain into the cylinder bore and eventually into the oil-pan (in embodiments in which the cylinder liner has ports along the bottom and the cylinder liner is not sitting on a step). Depending on the configuration of passages, the cooling media could be oil, water, ethylene-glycol, or gas (including air or a compressed inert gas such as nitrogen) or a combination of media carried in different passages separated from one another by appropriate sealed regions.

In preferred embodiments, one or more of the ports along the bottom of the cylinder liners are configured to receive generally U-shaped tubes that direct oil towards the interior of the cylinder bore. In such embodiments, the cylinder liner incorporates one or more piston squirters that do not rely on a separate circulation system.

Preferably the cylinder liner comprises at least one of aluminum and aluminum alloy, or consists of or comprises at least one material selected from the group consisting of: aluminum-based metal matrix composite (MMC), comprising a particulate reinforcement (e.g., DURALCAN®, containing silicon carbide, and manufactured by Alcan Aluminum Limited); superalloys; ceramic matrix composite (CMC); 'carbon graphite foam'; or manganese-bronze having a particulate reinforcement such as, but not limited to silicon carbide (e.g., from about 10% to about 35%). Preferably, the cylinder liner comprises MMC, CMC or carbon graphite foam, with at least one of silicon carbide, and silicon nitrate. The cylinder liners can manufactured by standard casting methods. Preferably, infusion casting is used; for example, aluminum-based alloys (e.g., eutecic, hypereutectic, or otherwise), with or without particulate reinforcement are cast into (e.g., infiltration casting) a porous 'preform' (e.g., MMC, CMC, ceramic, or carbon graphite foam 'preform'). Alternatively, embodiments could be made of other materials including ductile iron.

In particular embodiments, the cylinder liners consist of, comprise, or substantially comprise a material selected from the group consisting of carbon graphite foam, ceramic matrix composite ("CMC") having a two- or three-dimensionally interconnected crystalline ceramic phase and a non-contiguous metal phase dispersed within the interconnected ceramic phase (see, e.g., U.S. Pat. Nos. 5,620,791, 5,878,849 and 6,458,466, all of which incorporated herein by reference in their entirety), and combinations thereof.

The ceramic phase of the CMC may be a boride, oxide, carbide, nitride, silicide or combination thereof. Combinations include, for example, borocarbides, oxynitrides, oxycarbides and carbonitrides. The ceramic may include various dopant elements to provide a specifically desired microstructure, or specifically desired mechanical, physical, or chemical properties in the resulting composite. The metal phase of the CMC may be a metal selected from the Periodic Table Groups 2, 4-11, 13 and 14 and alloys thereof.

In particular embodiments, the CMC is produced by infiltrating a porous ceramic body with a metal, thus forming a composite. Such infiltration involves, for example, forming a porous ceramic 'preform' prepared from ceramic powder, such as in slip casting (e.g., a dispersion of the ceramic powder in a liquid, or as in pressing (e.g., applying pressure to powder in the absence of heat), and then infiltrating a liquid metal into the pores of said preform.

In particular embodiments, the material comprises a ceramic-metal composite comprised of a metal phase and a ceramic phase dispersed within each other, wherein the ceramic phase is present in an amount of at least 20 percent by volume of the ceramic-metal composite. In particular embodiments, the braking component is a metal substrate, such as aluminum, having laminated thereto a ceramic metal composite of a dense boron carbide-aluminum composite having high specific heat and low density.

In particularly preferred embodiments, the cylinder liner comprises 'carbon graphite foam'. Preferably, infusion casting is used. For example, an aluminum-based alloys (e.g., eutecic, hypereutectic, or otherwise), with or without particulate reinforcement are cast into (e.g., infiltration casting) a 'preform' of porous 'carbon graphite foam' (with or without particulate reinforcement, such as silicon carbide). Carbon graphite foam (developed at Oak Ridge National Laboratory, USA) has high thermal conductivity and also acts as super-conductor (see, e.g., U.S. Pat. Nos. 6,673,328, 6,663,842, 6,656,443, 6,398,994, 6,387,343 and 6,261,485, all of which are incorporated by reference herein in their entirety). Preferably the silicon carbide volume should be from about 10% to 35% to provide desired friction at wear plate rubbing surface. Infiltration of un-reinforced or reinforced alloy into carbon graphite foam 'preform' is during a suitable casting procedure including, but not limited to die casting, high-vacuum permanent mold casting, squeeze casting, or centrifugal casting. According to the present invention, carbon graphite foam can be included in the compositions of at least one of the cylinder liner, and any parts in contact therewith. According to the present invention, the use of carbon graphite foam 'preforms' not only substantially reduces manufacturing costs (e.g., relative to the use of ceramic 'preforms'), but provides an environmentally responsible cylinder liner, because carbon graphite foam is manufactured from a by-product of coal fabrication.

In preferred embodiments the cylinder liner comprises carbon graphite foam, and additionally comprises, or is in communication with at least one heating element (e.g., electrical resistive element), which is optionally in communication with external controller means, to allow for heating, or regulated heating of the cylinder liner (e.g., prior to or during engine cold-start periods, and/or idling periods).

These cylinder liners, and particularly those comprising carbon graphite foam, allow for more efficient cooling over prior art liners by allowing the cooling media to be in direct contact with the engine components where there is the greatest heat concentration; that is, in the cylinder liner. Preferably, the passages run the entire, or almost the entire length of the cylinder liners, and the inventive designs facilitate uniform cooling of the cylinder liners; avoiding hot spots that can lead to cracking and degradation of cylinder liners.

Additionally, by creating passages for the cooling media to pass through in direct contact with the cylinder liner, these cylinder liners reduce or eliminate the need for a complex series of passages within the engine block; a concomitant feature of prior art wet-sleeve and dry-sleeve cylinder liners. This reduction in passages within the engine block has a number of advantages, including but not limited to, ease and cost effectiveness of manufacture of engine blocks, the ability to cast more compact and lighter engine blocks and pistons, and lessening of the potential of failure of the cooling system during manufacture or during its operation.

By including the passages for the cooling media within the cylinder liner itself, this innovation overcomes the absence of uniform cooling present in prior art wet-sleeve design, and particularly in "V"-formation engines where the cooling medium reservoir is typically asymmetrically located.

The presence of the cooling media where it is most efficient in reducing overall engine heat means that a engine will run cooler and there will be fewer emissions, especially of nitrogen oxide.

The increased efficiency in cooling allows automotive manufacturers to utilize less cooling media—not only reducing the space needed to store the cooling media but also significantly decreasing overall weight (an important goal in the race to increase fuel-efficiency in automobiles with high horsepower engines). Unlike traditional wet-sleeve designs, particular inventive embodiments provide for simultaneous use of different cooling media, because the inventive cylinder liners allow for a plurality of independent passages. And, by varying the construction of the passages (two ports, one port and a window, or two windows), the cooling media can be: oil draining into a oil pan; water or coolant under pressure running through the cylinder liner and up through passages in the cylinder head; compressed inert gases such as nitrogen circulating within a closed loop; oil under pressure coming down through the cylinder head and being squirted on to the underside of the piston using a piston squirter, or combinations thereof.

In particular closed loop embodiments, a series of one-way check valves is used to exploit the property of fluids that they expand when heated and contract when cooled, to implement a cooling circuit that does not depend on external forces to circulate the cooling media through the passages.

In particular embodiments, stored heat, or battery—or electrically-driven heating elements in communication with the fluids circulating through the passages in the cylinder liner can also be utilized to pre-warm the liners before the automobile is started; leading to increased fuel efficiency and decreased emissions from not having to "warm up" the engine. In preferred embodiments the cylinder liner comprises carbon graphite foam, and additionally comprises, or is in communication with at least one heating element (e.g., electrical resistive element), which is optionally in communication with external controller means, to allow for heating, or regulated heating of the cylinder liner (e.g., prior to or during engine cold-start periods, and/or idling periods). Therefore, unlike prior art designs directed only at cooling the cylinder areas, aspects of the present invention additionally address the problem presented by engine 'cold-start' and idle periods. According to the present invention, the ability to warm or heat, or prewarm or preheat the cylinder liners substantially reduces excessive emissions and pollution otherwise generated because the cylinders are not at an appropriate temperature to provide for optimally efficient combustion. Therefore, not only do the inventive cylinder liners contribute to cooler engines and extended cylinder and engine life, but also address a serious problem in the transportation/trucking industry, and in the environment, and will significantly enable the transportation industry to operate within an increasingly more stringent regulatory environment.

Other embodiments incorporate sensor materials or devices (e.g., magnetic resistive devices) to monitor and manage the flow and temperature of the fluids circulating through the passages in the cylinder liner to optimize the temperature of the cylinder liner and decrease degradation of engine components and lower emissions.

Further, because the inventive cylinder liners are fundamentally cylindrical in shape and do not have complicated outer surface structures, they can be easily manufactured employing commonly-used manufacturing techniques, including die-casting, extrusions, the lost-foam method, or a combination thereof.

FIG. 1 shows one embodiment of the cylinder liner 122 according to the present invention. The cylinder liner 122 is generally in the shape of an annular cylinder with an outer surface 124 and an inner surface 126. The top 132 of the cylinder liner 122 incorporates an optional flange 128 that fits on a counterbore within the cylinder bore and contributes to holding the cylinder liner 122 in place. This embodiment contains a plurality of longitudinal passages each with a port 134 circularly arrayed along the top 132 of the cylinder liner 122. The passages are separated by walls 136 that run the entire axial length of the cylinder liner 122. Preferably the cylinder liner 122 comprises at least one of aluminum and aluminum alloy, or consists of or comprises at least one material selected from the group consisting of: aluminum-based metal matrix composite (MMC), comprising a particulate reinforcement (e.g., DURALCAN®, containing silicon carbide, and manufactured by Alcan Aluminum Limited); superalloys; ceramic matrix composite (CMC); 'carbon graphite foam'; or manganese-bronze having a particulate reinforcement such as, but not limited to silicon carbide (e.g., from about 10% to about 35%). Preferably, the cylinder liner comprises MMC, CMC or carbon graphite foam, with at least one of silicon carbide, and silicon nitrate.

Figure 2:
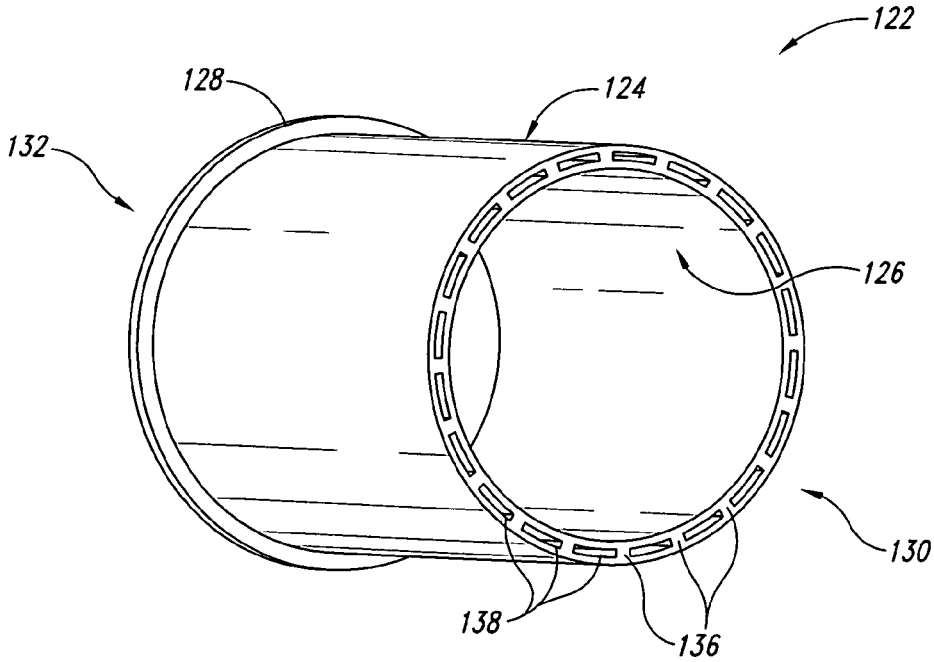
FIG. 2 is a view of the same embodiment of the cylinder liner as in FIG. 1 but from a different perspective showing openings 138 along the bottom of the cylinder liner (i.e., the end of the cylinder liner that is not proximate to the cylinder head).

FIG. 2 shows the same embodiment of the cylinder liner 122 as shown in FIG. 1 from a different perspective. The optional flange 128 at the top 132 of the cylinder liner 122 can be seen in this perspective. The passages in cylinder liner 122 traverse the entire length of the cylinder liner and terminate in ports 138 arrayed circularly along the bottom 130 of the cylinder liner 122. The walls 136 between the passages are seen to run the entire axial length of cylinder liner 122. This embodiment of the invention can be manufactured optionally using die-casting, extrusions, the lost-foam method, or a combination thereof.

Figure 3:
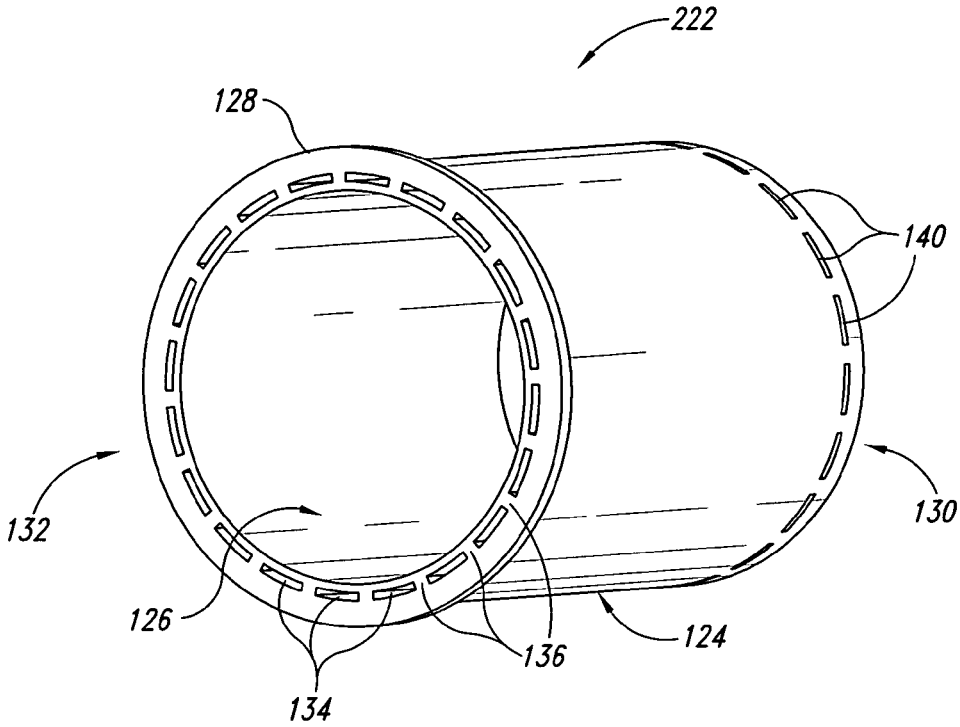
FIG. 3 is a view of a different embodiment of the of the inventive cylinder liner with openings along the top of the cylinder liner as well as a circular arrangement of openings 140 along the outer surface of the cylinder liner, close to the bottom of the cylinder liner. Optional groves parallel to the circular arrangement of openings, and arrayed one on either side of the openings arrangement, are not shown in this figure.

FIG. 3 shows a different embodiment of the cylinder liner 222. In this embodiment, the cylinder liner is generally in the shape of an annular cylinder with outer surface 124 and inner surface 126. The top 132 of the cylinder liner 222 incorporates an optional flange 128 that conforms to a counterbore in the cylinder bore and contributes in holding the cylinder liner 222 in place. This embodiment incorporates a plurality of passages corresponding to ports 134 circularly arrayed along the top 132 of the cylinder liner 222. The plurality of passages are separated by walls 136 that run parallel to the passages and hence parallel to the axis of the cylinder liner. The passages have a second opening through windows 140 on the outside surface 124 of the cylinder liner 222. The windows 140 are arrayed in a circular configuration perpendicular to the axis of the cylinder and near the bottom 130 of the cylinder liner 222. Two optional groves, one on each side of the window configuration and parallel to that circle, that would hold O-ring gaskets are not shown in this illustration of cylinder liner 222.

Preferably the cylinder liner 222 comprises at least one of aluminum and aluminum alloy, or consists of or comprises at least one material selected from the group consisting of: aluminum-based metal matrix composite (MMC), comprising a particulate reinforcement (e.g., DURALCAN®, containing silicon carbide, and manufactured by Alcan Aluminum Limited); superalloys; ceramic matrix composite (CMC); 'carbon graphite foam'; or manganese-bronze having a particulate reinforcement such as, but not limited to silicon carbide (e.g., from about 10% to about 35%). Preferably, the cylinder liner comprises MMC, CMC or carbon graphite foam, with at least one of silicon carbide, and silicon nitrate.

Although slightly more complicated to manufacture than cylinder liner 122 (with reference to FIG. 1 and FIG. 2), cylinder liner 222 is preferably manufactured by die-casting, the lost-foam method, or a combination thereof. Even more preferably, it is manufactured using infiltration casting of 'preforms' comprising or consisting of carbon graphite foam.

Figure 4:
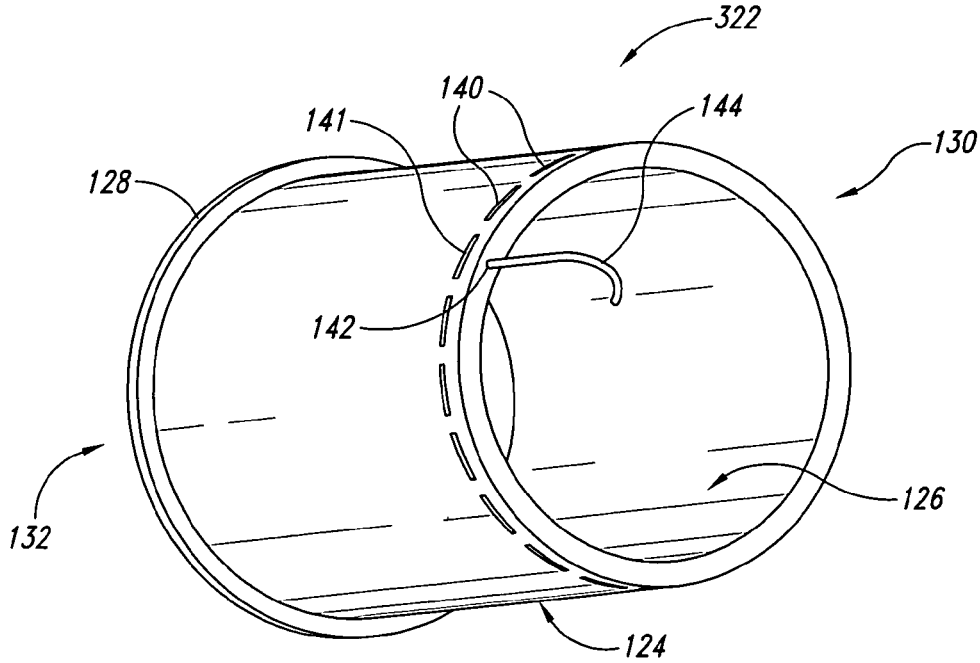
FIG. 4 is an exploded view of one embodiment of the inventive cylinder liner incorporating openings along the outer surface, near the bottom of the cylinder liner, as well as a piston squirter 144. Optional groves parallel to the circular arrangement of openings, and arrayed on either side of the openings arrangement, are not shown.

FIG. 4 shows an exploded view of an embodiment of cylinder liner 322 that incorporates a piston squirter 144. In this embodiment, the cylinder liner is generally in the shape of an annular cylinder with outer surface 124 and inner surface 126. The top 132 of the cylinder liner 322 incorporates an optional flange 128 that conforms to on a counterbore in the cylinder bore and contributes to holding the cylinder liner 322 in place. This embodiment incorporates a plurality of passages corresponding to windows 140 on the outer surface 124 of cylinder liner 322. The windows 140 are arrayed in a circular configuration perpendicular to the axis of the cylinder, and near the bottom 130 of the cylinder liner 322. Two optional groves, one on each side of the window configuration and parallel to that circle, that would hold O-ring gaskets are not shown in this illustration of cylinder liner 322.

The cylinder liner embodiment of FIG. 4 also incorporates a port 142 on the bottom 130 of the cylinder liner 322. The port 142 is at the end of a passage that has three openings: a port 134 (see FIG. 3) on the top 132 of the cylinder liner; a window 141 on the outer surface 124 of the cylinder liner; and a port 142 on the bottom 130 of the cylinder liner 322. Port 142 is designed to accept one end of a generally U-shaped (alternatively V-shaped) tube 144. The other end of tube 144 is directed generally towards the central axis of the cylinder liner, which corresponds to the central axis of the cylinder bore. By passing oil under pressure along the passage with openings 141 and 142, the combination of port 142 and U-shaped tube 144 functions as a piston squirter without requiring a separate circulation system. The oil under pressure passing through the passage with openings 141 and 142 is directed against the underside of the piston traveling within cylinder liner 322. This directed oil helps cool cylinder liner 322 and at the same time helps cool and lubricate the piston traveling within cylinder liner 322.

Preferably the cylinder liner 322 comprises at least one of aluminum and aluminum alloy, or consists of or comprises at least one material selected from the group consisting of: aluminum-based metal matrix composite (MMC), comprising a particulate reinforcement (e.g., DURALCAN®, containing silicon carbide, and manufactured by Alcan Aluminum Limited); superalloys; ceramic matrix composite (CMC); 'carbon graphite foam'; or manganese-bronze having a particulate reinforcement such as, but not limited to silicon carbide (e.g., from about 10% to about 35%). Preferably, the cylinder liner comprises MMC, CMC or carbon graphite foam, with at least one of silicon carbide, and silicon nitrate.

Cylinder liner 322 is preferably manufactured by die-casting, the lost-foam method, or a combination thereof. Even more preferably, it is manufactured using infiltration casting of 'preforms' comprising or consisting of carbon graphite foam.

Figure 5:
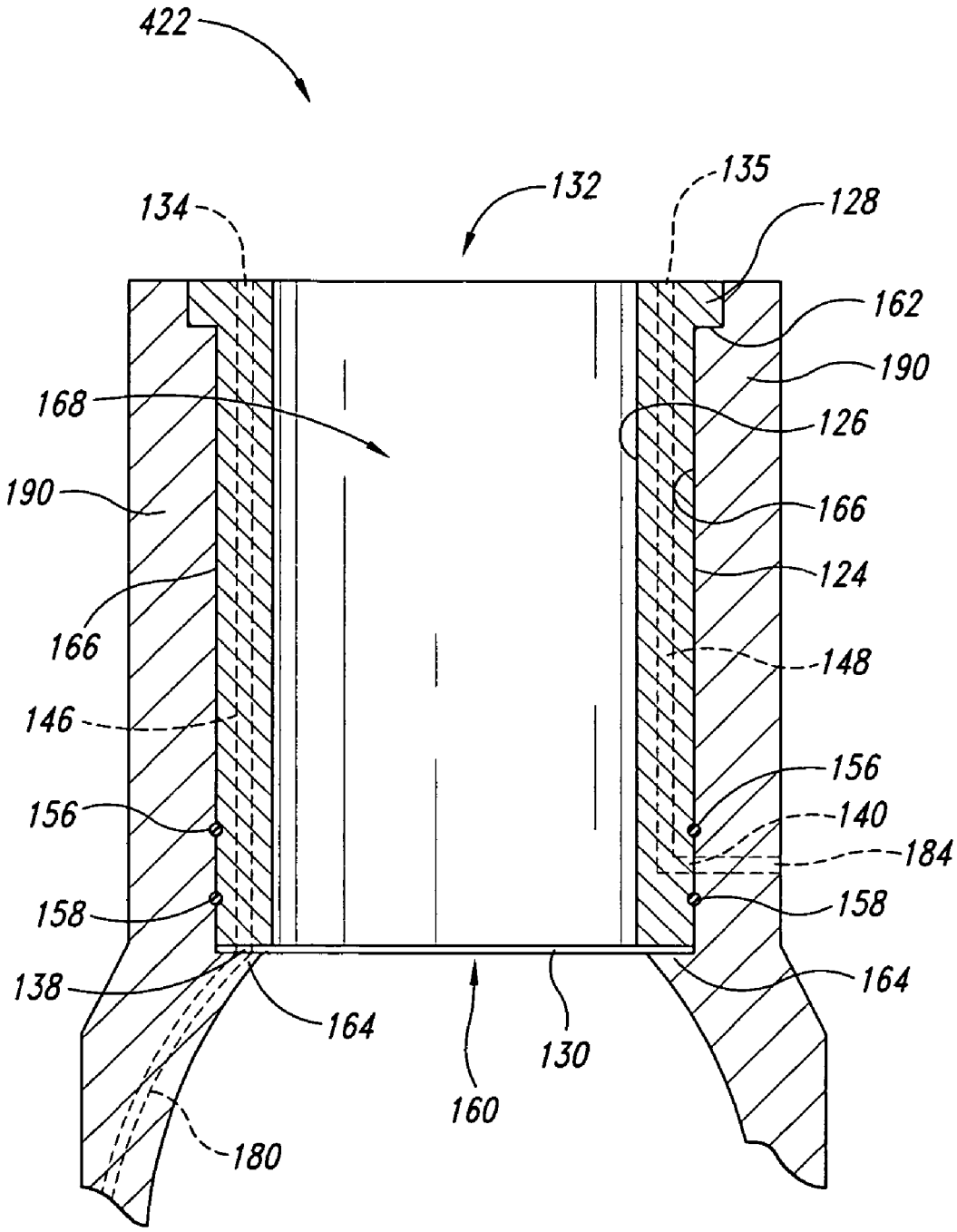
FIG. 5 is a cross-sectional view of a embodiment of the inventive cylinder liner placed within an exemplary cylinder bore. The embodiment illustrated includes passages 146 that have openings at both ends of the cylinder liner as well as passages 148 that have an opening at one end of the cylinder liner and a second opening on the outer surface of the cylinder liner. This diagram illustrates a cylinder bore that has a step 164 on which the cylinder liner sits.

FIG. 5 is a cross-sectional view of a particular embodiment of the invention in position within a cylinder bore. Cylinder liner 422 is generally in the shape of an annular cylinder with an outer surface 124 and an inner surface 126. The top 132 of the cylinder liner 422 incorporates an optional flange 128 that conforms to a counterbore 162 within the cylinder bore 168 and contributes to holding the cylinder liner 422 in place.

This embodiment of the cylinder bore 168 includes a step 164 on which the cylinder liner 422 sits. In order to provide a sealing fit and to prevent wear and tear, a gasket 160 is optionally placed between the bottom 130 of cylinder liner 422 and the step 164.

A passage 146 has an opening in a port 134 along the top 132 of the cylinder liner 422 and another opening in a port 138 along the bottom 130 of the cylinder liner 422. The port 138 is aligned with an opening in the gasket 160 and an opening for fluid passage 180 within the body of the engine block 190. This arrangement creates a passage that incorporates port 134, passage 146, port 138, and passage 180, and runs from the top 132 of cylinder block 422 into the engine block 190. When port 134 is aligned with a opening for a passage in the cylinder head, this arrangement would allow cooling media to flow through the cylinder head, within the surfaces of the cylinder line 422, and into the engine block 190. Or by reversing the flow, it would carry cooling media through the engine block 190, through the surfaces of the cylinder liner 422, and into passages within the cylinder head.

Cylinder liner 422, includes another passage 148 that has one opening in a port 135 along the top 132 of cylinder liner 422 and another opening in a window 140 on the outer surface 124 of cylinder liner 422. Because window 140 is towards the bottom 130 of cylinder liner 422, passage 148 runs almost the entire length of cylinder liner 422, facilitating uniform cooling of the cylinder liner 422 when a cooling medium is circulated through passage 148. Note that there are O-rings 156 and 158 arrayed on either side of 148 and running along the entire outer surface 124 of the cylinder liner 422 parallel or generally parallel to the bottom 130 of cylinder liner 422. O-rings 156 and 158 create a sealed annular region between the outer surface 124 of cylinder liner 422 and interior surface 166 of the cylinder bore. The window 140 is aligned with an opening for a fluid passage 184 that runs within the engine block 190. Because any cooling media circulated through passage 148 would be contained in the sealed, annular region formed by O-rings 156 and 158, the outer surface 124 of cylinder liner 422, and the interior surface 166 of the cylinder bore, the cooling media in passage 148 is optionally different from the cooling media circulated through passage 146.

Preferably the cylinder liners 122, 222, 322 and 422 comprise at least one of aluminum and aluminum alloy, or consists of or comprises at least one material selected from the group consisting of: aluminum-based metal matrix composite (MMC), comprising a particulate reinforcement (e.g., DURALCAN®, containing silicon carbide, and manufactured by Alcan Aluminum Limited); superalloys; ceramic matrix composite (CMC); 'carbon graphite foam'; or manganese-bronze having a particulate reinforcement such as, but not limited to silicon carbide (e.g., from about 10% to about 35%). Preferably, the cylinder liner comprises MMC, CMC or carbon graphite foam, with at least one of silicon carbide, and silicon nitrate. The cylinder liners can manufactured by standard casting methods (e.g., by die-casting, the lost-foam method, or a combination thereof). Preferably, infusion casting is used; for example, aluminum-based alloys (e.g., eutecic, hypereutectic, or otherwise), with or without particulate reinforcement are cast into (e.g., infiltration casting) a porous 'preform' (e.g., MMC, CMC, ceramic, or carbon graphite foam 'preform'). Alternatively, embodiments could be made of other materials including ductile iron.

Casting. In particular aspects, the cylinder liners are cast in a mold, by any suitable casting process, including but not limited to die casting, sand casting, permanent mold casting, squeeze casting, or lost foam casting. Preferably, casting is by die-casting. Alternatively, casting of the cylinder liners is by spin-casting, such as that generally described in U.S. Pat. No. 5,980,792 to Chamlee (incorporated herein by reference in its entirety). For example, aluminum-based metal matrix composite (MMC) comprising a particulate reinforcement (e.g., Duralcan®) containing silicon carbide) is centrifugally spin-casted to cause and create functionally beneficial particulate (sic) distributions (gradients). In the present instance such casting methods increase particle density at friction surfaces.

Alternatively, aluminum-based alloys, including eutectic and hypereutectic alloys such as 380, 388, 398, 413, or others such as 359-356-6061, optionally containing particulate reinforcement such as silicon carbide, or aluma oxides, ceramic powders or blends, can be cast into (e.g., by infiltration casting) a ceramic fiber-based porous 'preform' of desired specification using discontinuous alumina-silicate (e.g., Kaowool Saffil Fibers), silicon carbide, ceramic powders, or blends of the preceding. Reinforced or non-reinforced aluminum-based alloys infiltrate the 'preform' during the casting procedure, making a MMC with selective reinforcement. Preferably, casting process is performed by a suitable method, including, but not limited to die casting. Alternatively, permanent mold high-vacuum, squeeze casting, lost foam, or centrifugal casting (e.g., U.S. Pat. No. 5,980,792) can be employed.

In particularly preferred embodiments, the cylinder liners 122, 222, 322 and 422 comprise 'carbon graphite foam'. Preferably, infusion casting is used. For example, an aluminum-based alloys (e.g., eutectic, hypereutectic, or otherwise), with or without particulate reinforcement are cast into (e.g., infiltration casting) a 'preform' of porous 'carbon graphite foam' (with or without particulate reinforcement, such as silicon carbide). Carbon graphite foam (developed at Oak Ridge National Laboratory, USA) has high thermal conductivity and also acts as super-conductor (see, e.g., U.S. Pat. Nos. 6,673,328, 6,663,842, 6,656,443, 6,398,994, 6,387,343 and 6,261,485, all of which are incorporated by reference herein in their entirety). Preferably the silicon carbide volume should be from about 10% to 35% to provide desired friction at wear plate rubbing surface. Infiltration of un-reinforced or reinforced alloy into carbon graphite foam 'preform' is during a suitable casting procedure including, but not limited to die casting, high-vacuum permanent mold casting, squeeze casting, or centrifugal casting. According to the present invention, carbon graphite foam can be included in the compositions of at least one of the cylinder liner, and any parts in contact therewith. According to the present invention, the use of carbon graphite foam 'preforms' not only substantially reduces manufacturing costs (e.g., relative to the use of ceramic 'preforms'), but provides an environmentally responsible cylinder liner, because carbon graphite foam is manufactured from a by-product of coal fabrication.

While various embodiments and preferred embodiments of the present invention have been illustrated and described herein, it will be appreciated that various changes can be made therein without departing from the spirit and scope of the invention.

The invention claimed is:

1. A cylinder liner for a cylinder bore, comprising:

a generally annular cylindrical member having top and bottom cylinder ends, and having parallel or generally parallel inner and outer surfaces;

at least one fluid channel integrated within and between the surfaces of the member, the channel having first and second channel ends, the channel traversing at least a majority of the cylinder length; and first and second channel openings at or near the first and second channel ends, respectively, wherein one channel opening opens to at least one of a cylinder end and the outer cylinder surface, wherein the other channel opening opens to at least one of a cylinder end, the other cylinder end, the outer cylinder surface, and the inner cylinder surface, and wherein the channel and channel openings defining a fluid passageway.

2. The cylinder liner of claim 1, comprising a plurality of separate fluid channels.

3. The cylinder liner of claim 1, wherein the liner comprises at least one material selected from the group consisting of consisting of a aluminum-based metal matrix composite (MMC) with a particulate reinforcement, superalloys, ceramic matrix composite (CMC), and carbon graphite foam.

4. The cylinder liner of claim 1, wherein the channel openings are at the channel ends.

5. The cylinder liner of claim 1, wherein the channel ends and channel openings are at the cylinder ends.

6. The cylinder liner of claim 5, further comprising a third opening positioned along the channel somewhere between the first and second openings, wherein the third opening opens to the outer cylinder surface.

7. The cylinder liner of claim 6, further comprising a fluid-directing tube connected to a channel opening at the bottom cylinder end.

8. The cylinder liner of claim 1, wherein the first channel opening is at a cylinder end, and the second channel opening is at, at least one of, the outer cylinder surface and the inner cylinder surface.

9. The cylinder liner of claim 8, comprising a plurality of such channels all having one channel opening at the same cylinder end, and all having one channel opening at the outer cylinder surface near the other cylinder end.

10. The cylinder liner of claim 9, wherein the outer surface channel openings are positioned in a circular arrangement running parallel to the cylinder ends.

11. The cylinder liner of claim 10, further comprising two grooves on the outer cylinder surface suitable to accommodate sealing means, the groves parallel or nearly parallel to the cylinder ends and situated so that the channel openings arrangement is positioned therebetween.

12. The cylinder liner of claim 11, wherein sealing is by use of two O-rings within the grooves.

13. The cylinder liner of claim 1, further comprising flange at the top cylinder end, the flange suitable to be received into a counterbore in a cylinder bore.

14. The cylinder liner of claim 1, further comprising a circular trough perpendicular to the cylinder axis and recessed into the outer cylinder surface, wherein a channel opening opens into the trough.

15. The cylinder liner of claim 14, comprising a plurality of channels, each channel having a channel opening that opens into the trough to form a circular arrangement of channel openings within the trough.

16. The cylinder liner of claim 1, wherein the liner comprises carbon graphite foam.

17. The cylinder liner of claim 1, comprising or in communication with a heating element suitable to increase the temperature of the liner.

18. A cylinder liner, comprising carbon graphite foam.

19. The cylinder liner of claim 18, further comprising or in communication with a heating element suitable to increase the temperature of the liner.

20. The cylinder liner of claim 18, further comprising a integrated fluid channel defining a fluid passageway through the liner.

21. The cylinder liner of claim 1, wherein the at least one channel traverses the majority of, or substantially throughout, the interior of the cylinder liner.

* * * * *